US010136709B2

(12) United States Patent
Ma

(10) Patent No.: US 10,136,709 B2
(45) Date of Patent: Nov. 27, 2018

(54) CANTILEVER UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/478,284

(22) Filed: Sep. 5, 2014

(65) Prior Publication Data

US 2015/0068567 A1 Mar. 12, 2015

Related U.S. Application Data

(60) Provisional application No. 61/874,936, filed on Sep. 6, 2013, provisional application No. 61/880,045, filed on Sep. 19, 2013.

(51) Int. Cl.
*A45B 23/00* (2006.01)
*A45B 25/14* (2006.01)

(52) U.S. Cl.
CPC ..... *A45B 23/00* (2013.01); *A45B 2023/0012* (2013.01); *A45B 2023/0037* (2013.01); *A45B 2025/146* (2013.01)

(58) Field of Classification Search
CPC ..... A45B 23/00; A45B 2023/0031; A45B 2023/0037
USPC ..... 135/20.1, 21
See application file for complete search history.

(56) References Cited

U.S. PATENT DOCUMENTS 2,183,833 A 12/1939 Farhar
2,235,518 A 3/1941 Goshaw
2,475,406 A 7/1949 Russell
2,661,752 A 12/1953 Kampf et al.
2,670,133 A 2/1954 Volker
2,721,569 A 10/1955 Militano
2,724,396 A 11/1955 Pereira
2,905,187 A 9/1959 Croce
2,914,154 A 11/1959 Russell
3,120,238 A 2/1964 Glatz
3,129,715 A 4/1964 Fleischer et al.
3,142,307 A 7/1964 Danciart et al.
3,145,720 A 8/1964 Torii
3,150,671 A 9/1964 Frey
(Continued)

FOREIGN PATENT DOCUMENTS

CN 2419864 Y 2/2001
CN 2441342 Y 8/2001
(Continued)

OTHER PUBLICATIONS

Extended European Search Report issued in European Patent Application No. 14183987.8, dated Oct. 15, 2014, in 6 pages.
(Continued)

*Primary Examiner* — David R Dunn
*Assistant Examiner* — Danielle Jackson
(74) *Attorney, Agent, or Firm* — Knobbe Martens Olson & Bear LLP

(57) ABSTRACT

A cantilever umbrella assembly is provided that includes an upright pole, a runner, a transverse pole, and a canopy. The upright pole includes an upright guide surface. The runner is coupled with the upright pole and has a bearing coupled with the guide surface for guiding the runner along the upright pole. The cantilever umbrella assembly includes a deployable tension member with a first end disposed in the transverse pole and a second end coupled with the canopy.

25 Claims, 5 Drawing Sheets

(56) References Cited

U.S. PATENT DOCUMENTS

| | | | |
|---|---|---|---|
| 3,175,568 | A | 3/1965 | Kafka |
| 3,182,673 | A | 5/1965 | Small |
| 3,486,514 | A | 12/1969 | Prescott |
| 3,765,434 | A | 10/1973 | Riggs |
| 3,926,202 | A | 12/1975 | Uthemann et al. |
| 4,148,164 | A | 4/1979 | Humphrey |
| 4,582,078 | A | 4/1986 | Ma |
| 4,586,525 | A | 5/1986 | Glatz et al. |
| 4,606,366 | A | 8/1986 | Collet |
| 4,622,987 | A | 11/1986 | Redl et al. |
| 4,674,523 | A | 6/1987 | Glatz |
| 4,697,606 | A | 10/1987 | Ma |
| 4,878,509 | A | 11/1989 | Tung |
| 5,002,081 | A | 3/1991 | Stromeyer |
| 5,029,596 | A | 7/1991 | Tung |
| 5,086,797 | A | 2/1992 | Earnshaw et al. |
| 5,116,258 | A | 5/1992 | Vennik |
| 5,156,395 | A | 10/1992 | Smith |
| 5,161,764 | A | 11/1992 | Roney |
| 5,349,975 | A | 9/1994 | Valdner |
| 5,437,297 | A | 8/1995 | Crisman et al. |
| 5,492,232 | A | 2/1996 | Ohm |
| 5,499,644 | A | 3/1996 | Geniele |
| 5,584,564 | A | 12/1996 | Phyle |
| 5,611,364 | A | 3/1997 | Woods et al. |
| 5,678,585 | A | 10/1997 | May |
| 5,711,333 | A | 1/1998 | Vanderminden, Sr. |
| 5,735,302 | A | 4/1998 | Saliva |
| 5,785,069 | A | 7/1998 | Glatz |
| D398,443 | S | 9/1998 | Bolle |
| 5,845,665 | A | 12/1998 | Koehn |
| 5,868,152 | A | 2/1999 | Brown |
| 5,871,024 | A | 2/1999 | Vendermindern, Sr. |
| 5,937,882 | A | 8/1999 | Harbaugh |
| 5,960,806 | A | 10/1999 | Steiner |
| 6,014,980 | A | 1/2000 | Glatz |
| D434,215 | S | 11/2000 | Lin |
| 6,152,156 | A | 11/2000 | Tung |
| D434,556 | S | 12/2000 | Lin |
| 6,196,244 | B1 | 3/2001 | Haddad et al. |
| 6,209,147 | B1 | 4/2001 | Wheaton |
| 6,220,261 | B1 | 4/2001 | Glatz |
| 6,311,705 | B1 | 11/2001 | Ma |
| 6,330,886 | B1 | 12/2001 | Culver |
| 6,435,444 | B1 | 8/2002 | Lin |
| 6,446,650 | B1 | 9/2002 | Ma |
| 6,478,037 | B2 | 11/2002 | Tung |
| 6,520,192 | B1 | 2/2003 | Lo |
| 6,571,403 | B2 | 6/2003 | Wheaton |
| 6,575,182 | B2 | 6/2003 | Tung |
| 6,575,183 | B2 | 6/2003 | Tung |
| D477,458 | S | 7/2003 | Goldwitz |
| 6,588,438 | B1 | 7/2003 | Steiner |
| 6,607,002 | B2 | 8/2003 | Reese |
| 6,619,306 | B2 | 9/2003 | Ma |
| 6,662,815 | B2 | 12/2003 | Tung |
| 6,761,180 | B1 | 7/2004 | Lai |
| D497,479 | S | 10/2004 | Yu |
| 6,827,094 | B1 | 12/2004 | Bramwells |
| 6,837,255 | B2 | 1/2005 | Bunch et al. |
| 6,840,253 | B2 | 1/2005 | Ma |
| 6,851,823 | B2 | 2/2005 | Bilotti |
| 6,923,193 | B2 | 8/2005 | Chen |
| 6,926,019 | B2 | 8/2005 | Glatz |
| 6,945,263 | B2 | 9/2005 | Li |
| 6,953,043 | B2 | 10/2005 | Yu |
| 6,988,504 | B1 | 1/2006 | Goldwitz |
| D518,629 | S | 4/2006 | Ma |
| 7,108,388 | B2 | 9/2006 | Li |
| 7,134,442 | B2 | 11/2006 | Ma |
| 7,156,114 | B2 * | 1/2007 | Lo ..... A45B 23/00 135/20.1 |
| 7,207,343 | B2 | 4/2007 | Earnshaw et al. |
| 7,255,118 | B2 | 8/2007 | Vardy et al. |
| 7,341,068 | B2 | 3/2008 | Liu |
| 7,398,790 | B2 | 7/2008 | Glatz |
| 7,412,985 | B2 | 8/2008 | Ma |
| 7,493,909 | B2 | 2/2009 | Ma |
| 7,520,289 | B1 | 4/2009 | Barber |
| 7,533,680 | B2 | 5/2009 | Ma |
| 7,556,051 | B2 | 7/2009 | Lai |
| 7,708,022 | B2 | 5/2010 | Ma |
| 7,717,121 | B2 | 5/2010 | Glatz |
| D621,600 | S | 8/2010 | He |
| 7,866,331 | B2 | 1/2011 | Glatz |
| 7,886,755 | B2 | 2/2011 | Tung |
| 7,913,707 | B2 | 3/2011 | Lai |
| 7,918,054 | B2 | 4/2011 | Grafton |
| D638,622 | S | 5/2011 | He |
| 7,980,261 | B2 | 7/2011 | Glatz |
| 8,066,021 | B2 | 11/2011 | Ma |
| 8,104,492 | B2 | 1/2012 | Dan |
| 8,113,223 | B2 | 2/2012 | Wang et al. |
| 8,360,080 | B2 | 1/2013 | Liu et al. |
| 8,522,804 | B1 | 9/2013 | Tung |
| 9,220,325 | B2 | 12/2015 | Ma |
| 9,237,785 | B2 | 1/2016 | Ma |
| 9,289,038 | B2 | 3/2016 | Ma |
| 9,642,421 | B2 | 5/2017 | Ma |
| 9,930,942 | B2 | 4/2018 | Ma |
| 2002/0083969 | A1 | 7/2002 | Tung |
| 2002/0104557 | A1 | 8/2002 | Tung |
| 2002/0129847 | A1 | 9/2002 | Ma |
| 2002/0174887 | A1 | 11/2002 | Reese |
| 2003/0010366 | A1 | 1/2003 | Glatz |
| 2003/0015230 | A1 | 1/2003 | Glatz |
| 2004/0031513 | A1 | 2/2004 | Bunch et al. |
| 2004/0055627 | A1 | 3/2004 | Moga |
| 2004/0055628 | A1 | 3/2004 | Yu |
| 2004/0069333 | A1 | 4/2004 | Ma |
| 2004/0177871 | A1 | 9/2004 | Harbaugh |
| 2004/0182429 | A1 | 9/2004 | Chen |
| 2004/0261827 | A1 | 12/2004 | Chen |
| 2005/0013130 | A1 | 1/2005 | Li |
| 2005/0016571 | A1 | 1/2005 | Wu |
| 2005/0028852 | A1 | 2/2005 | Reese |
| 2005/0041425 | A1 | 2/2005 | Li |
| 2005/0183762 | A1 | 8/2005 | Ma |
| 2005/0229957 | A1 | 10/2005 | Glatz |
| 2005/0268952 | A1 | 12/2005 | Ma |
| 2005/0268953 | A1 | 12/2005 | Ma |
| 2006/0081277 | A1 | 4/2006 | Liu |
| 2006/0169307 | A1 | 8/2006 | Lo |
| 2006/0201542 | A1 | 9/2006 | Ma |
| 2006/0243311 | A1 | 11/2006 | Glatz |
| 2006/0278262 | A1 | 12/2006 | Ma |
| 2007/0074751 | A1 | 4/2007 | Fraser |
| 2007/0163632 | A1 | 7/2007 | Chang |
| 2007/0209688 | A1 | 9/2007 | Earnshaw |
| 2008/0236640 | A1 | 10/2008 | Huali |
| 2010/0051074 | A1 | 3/2010 | Dan |
| 2010/0101614 | A1 | 4/2010 | Wang et al. |
| 2010/0192997 | A1 | 8/2010 | Liu et al. |
| 2010/0212705 | A1 | 8/2010 | Tung |
| 2011/0005558 | A1 | 1/2011 | Lai |
| 2013/0092200 | A1 | 4/2013 | May |
| 2013/0333734 | A1 | 12/2013 | Ma |
| 2014/0158173 | A1 | 6/2014 | Li et al. |
| 2014/0166060 | A1 | 6/2014 | Ma |
| 2014/0230867 | A1 | 8/2014 | Ma |
| 2014/0311537 | A1 | 10/2014 | Ma |
| 2015/0059815 | A1 | 3/2015 | Xiong |
| 2016/0183647 | A1 | 6/2016 | Ma |

FOREIGN PATENT DOCUMENTS

| | | | |
|---|---|---|---|
| CN | 2621472 | Y | 6/2004 |
| CN | 2843147 | Y | 12/2006 |
| CN | 2896981 | | 5/2007 |
| CN | 201001460 | Y | 1/2008 |
| CN | 201001463 | Y | 1/2008 |
| CN | 201076109 | Y | 6/2008 |
| CN | 201135192 | Y | 10/2008 |
| CN | 201197439 | Y | 2/2009 |

(56) References Cited

FOREIGN PATENT DOCUMENTS

| | | |
|---|---|---|
| CN | 201207982 Y | 3/2009 |
| CN | 201518827 U | 7/2010 |
| DE | 580503 | 7/1933 |
| DE | 2259192 | 6/1974 |
| DE | 3229776 | 4/1983 |
| DE | 3820573 | 8/1989 |
| DE | 297 12 024 | 9/1997 |
| DE | 299 06 116 | 8/1999 |
| DE | 20205561 | 7/2002 |
| DE | 10 2008 034 985 | 2/2010 |
| EP | 0 392 989 | 10/1990 |
| EP | 1 400 186 | 3/2004 |
| EP | 1 700 536 | 9/2006 |
| EP | 2 103 230 | 9/2009 |
| EP | 2 425 738 | 3/2012 |
| GB | 22218 | 9/1911 |
| WO | WO 97/04682 | 2/1997 |
| WO | WO 00/55456 | 9/2000 |
| WO | WO 05/018369 | 7/2004 |

OTHER PUBLICATIONS

Extended European Search Report issued in European Patent Application No. 14183979.5, dated Oct. 16, 2014, in 6 pages.
Extended European Search Report issued in European Patent Application No. 14185661.7, dated Feb. 4, 2015, in 8 pages.
Activa Leisure, 2010 Product Catalog.
Treasure Garden, 2010 Product Catalog.
Operation Manual Easy Sun Parasol Sunshade (Issue: 07.2004) pp. 1-17.
Treasure Garden's product brochure identified as "AG3 9' Cantilever Umbrella", p. 2.
Extended European Search Report issued in European Patent Application No. 14155827.0, dated Apr. 29, 2014, in 6 pages.
Notice of Allowance issued in U.S. Appl. No. 14/478,275, dated Aug. 19, 2015, in 19 pages.

* cited by examiner

CANTILEVER UMBRELLA

BACKGROUND OF THE INVENTION

Field of the Invention

The application relates to the field of shade structures, particularly to umbrella or parasol with an offset support pole and a boom mounted canopy control device.

Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that comprises a fabric-like material mounted over a plurality of support ribs. The support ribs can be collapsed into a storage position for the canopy assembly and can be deployed and supported in position to hold up and extend the fabric and thereby provides protection from the elements. The canopy assembly is generally supported from beneath or from above. Umbrellas supported from above have the advantage of providing space below the canopy where people can sit without the obstruction of a pole extending from below the canopy to the ground. Umbrellas supported from above, sometimes called cantilevered umbrellas, can be opened by extending the canopy which causes a fixed cable to be tensioned and thereby to pull the frame of the canopy into an enlarged configuration. Other embodiments provide a mechanism for tensioning the canopy frame disposed on the side pole, either in a fixed position or on a slide.

SUMMARY OF THE INVENTION

Disposing the canopy frame tensioning cable on the side-post or runner is disadvantageous in that the cable is lengthened more than it needs to be. Also, the cable must be threaded through a more complex path than is needed to provide the function of opening and closing of the umbrella. Thus, there is a need for a new umbrella assembly where the canopy controls are disposed on a cantilevered beam, boom or transverse member whereby a tension member thereof can be shortened. This can also provide for a less complex threading of the tension member within the umbrella because fewer pulleys, hubs or wheels may be required.

More generally, there is a need for new cantilever umbrellas include more flexible operation of a canopy thereof. It would be advantageous to provide canopy operation mechanisms that can positively control a configuration of the umbrella, such as the opening and closing of the canopy, independent of a state of elevation or tilt of the umbrella. It would be advantageous to provide canopy control from a position on a transverse member or boom, such that the canopy control is not mounted on an upright pole or slider mounted to travel on the upright pole.

In one embodiment, a cantilever umbrella is provided that includes a canopy, a first umbrella frame pole, a runner, a second umbrella frame pole, and a canopy control module. The canopy is configured to shelter an area. The first umbrella frame pole supports the canopy. The first umbrella frame pole includes a channel disposed between top and bottom portions of the first umbrella frame pole along a side thereof. The runner is disposed about the first umbrella frame pole. The runner has a housing and a clamp mounted to the housing. The clamp is configured to apply pressure to the first umbrella frame pole at positions along the length of the first umbrella frame pole. The second umbrella frame pole is disposed transverse to the first umbrella frame pole.

The second pole has a first end coupled with the housing of the runner and a second end coupled with the canopy. The canopy control module is disposed on the second umbrella frame pole. In some embodiments, the canopy control module is disposed adjacent to the runner. The canopy control module includes a mechanism for opening and closing the canopy.

The mechanism for opening and closing the canopy can include a crank actuated control member disposed within the second umbrella frame pole. The crank actuated control member includes a spool for elevating a lower hub of the canopy.

In another embodiment, a cantilever umbrella assembly includes an upright pole, a runner, and a clamping mechanism. The cantilever support assembly also includes a transverse pole having an end coupled with the runner and a canopy. The upright pole includes an upright guide surface. The runner is coupled with the upright pole. The runner has a bearing disposed in the guide surface for guiding the runner along the upright pole. The clamping mechanism coupled with the runner is adapted to hold the runner at a selected elevation along the upright pole. The canopy controller coupled with the transverse pole to adjust the configuration of the umbrella.

In another embodiment, a cantilever umbrella assembly is provided that includes an upright pole, a runner, a transverse pole, and a canopy. The upright pole includes an upright guide surface. The runner is coupled with the upright pole and has a bearing coupled with the guide surface for guiding the runner along the upright pole. The cantilever umbrella assembly includes a deployable tension member with a first end disposed in the transverse pole and a second end coupled with the canopy.

In some embodiments, the cantilever umbrella assembly a securing device, such as a clamp is provided to interface between the runner and the upright pole. The securing device is adapted to hold the runner at a selected elevation along the upright pole.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
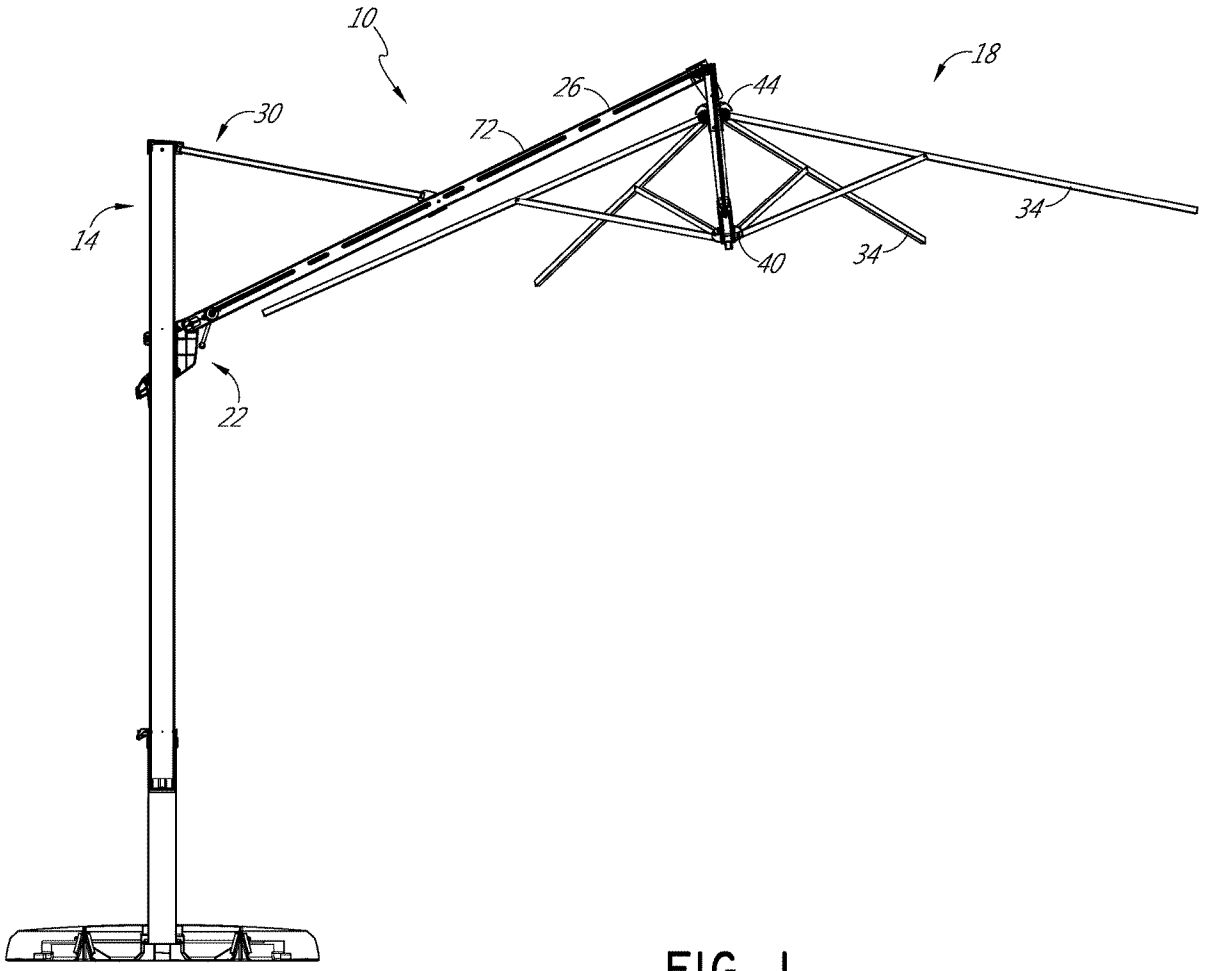
FIG. 1 is a side view of a cantilever umbrella assembly.

FIG. 1 shows major components of a cantilever umbrella 10 according to this application. The umbrella 10 includes a first umbrella frame pole 14, a canopy 18 and a runner 22. The canopy 18 is coupled to the first umbrella frame pole 14 by a second umbrella frame pole 26. As discussed in greater detail below, the runner 22 is coupled with the pole 14 in a manner that permits the runner to travel up and down along a mid-section of the pole. The runner 22 is sometimes referred to as a slide. The umbrella 10 can be stowed when the runner 22 is in a lowered position (below that of FIG. 1). The canopy 18 can be level, e.g., horizontal, in an elevated position of the runner 22 (higher than that of FIG. 1). In some embodiments, when the runner 22 is fully elevated the canopy 18 can be tilted toward the pole 14. The runner 22 can also be disposed below the position corresponding to a level canopy 18, as illustrated in FIG. 1 to tile the canopy 18 outward.

A strut 30 can be provided to couple an upper end of the first pole 14 with the second umbrella frame pole 26 at a position along the length thereof. In one embodiment, mounting brackets, which can include one or more flanges, are provided at the top of the pole 14 and on the second pole 26 to which the strut 30 is pivotally connected.

In the illustrated embodiment, the canopy 18 is supported from above by the second pole 26. For example, the pole 26 can extend along and above the top of the canopy 18. The canopy 18 generally has a fabric member disposed over a plurality of ribs 34. The fabric, though not shown, would be disposed below the second pole 26 in the FIG. 1 view. In another embodiment, the second pole 26 can be disposed below the fabric, e.g., extending along a position of one of ribs 34 or even disposed below the ribs.

As discussed further below, the opening and closing of the umbrella 10 is provided by moving a lower hub 40 relative to an upper hub 44. In one arrangement, a shaft 48 extends downward from the upper hub 44. A lower end of the shaft 48 has a conical end portion 52. A sleeve 56 extending upward from the lower hub 40 includes a conical recess 60 into which the conical end portion 52 can be received.

Figure 2:
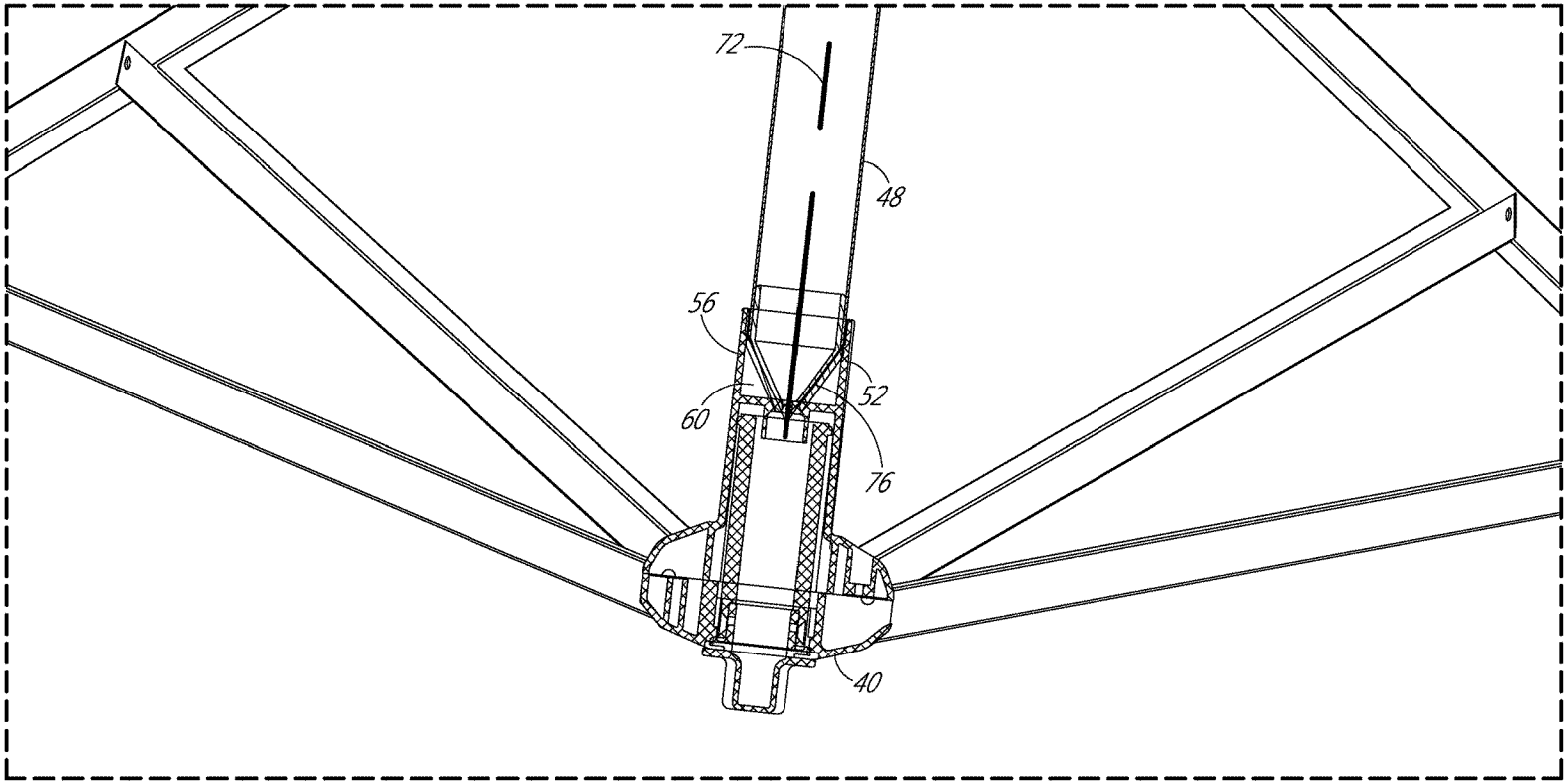
FIG. 2 is a detail view of a portion of a canopy assembly.
Figure 3:
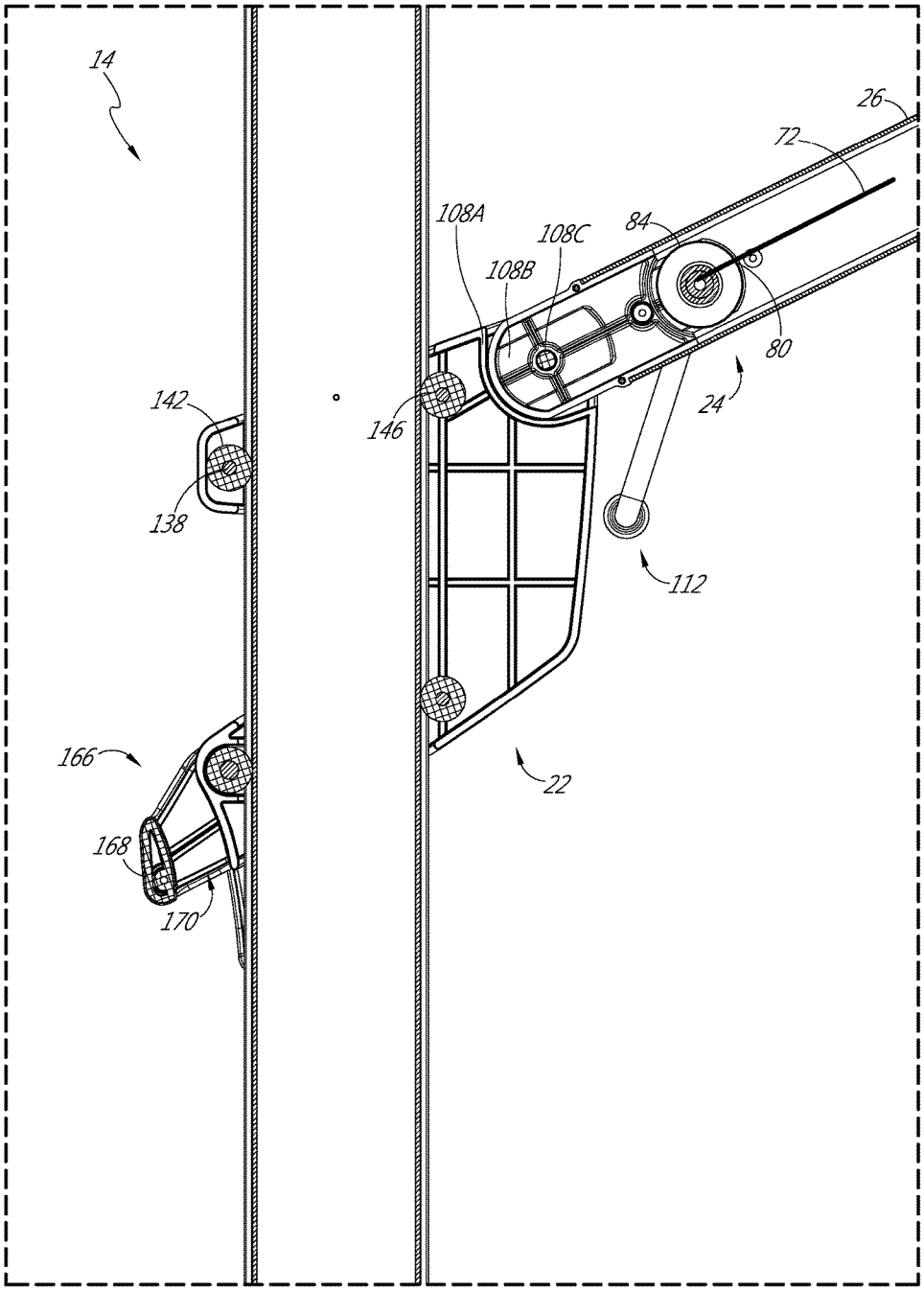
FIG. 3 is a detail view of a portion of a cantilever umbrella assembly showing an internal portion of a runner, a transverse pole, and a canopy control module.

FIGS. 1-3 show schematically in a thick dashed line the path of a tension member 72 that can be used to open and close the umbrella. In some embodiments, the tension member 72 is deployable in that it can be rolled-up or otherwise stowed and unrolled or unfurled by a device. This is distinct from a fixed cable arrangement where the cable is tensioned only by extending the canopy out from an upright pole. The tension member 72 has a first end 76 coupled with a lower hub 40 and a second end 80 coupled with a spool 84. The tension member 72 can be threaded through hollow spaces in the second pole 26, the shaft 48, and the sleeve 56 to act on the lower hub 40 to pull it up or allow it to be lowered. For example, by winding the tension member 72 onto the spool 84 the tension in the tension member 72 is increased. The increased tension enables the lower hub 40 to be raised until the conical recess 60 is just below the conical end portion 52. As these structures initially come together, the conical surfaces guide the shaft 48 and sleeve 56 into engagement. Advantageously the tension member 72 has two lengths. A first span extends from within the second pole 26 to a location above the upper hub 44. A second span extends from the upper hub 44 to the lower hub 40. The transition from the first to the second span of the tension member 72 can be over a pulley. By locating the spool 82 in the second frame member 26, the complexity of the routing of the tension member is greatly reduced. Also, the configuration of the first span at least adjacent to the runner 22 is substantially constant throughout the range of motion of the runner 22. This is because there are no pulleys or joints between the spool 84 and the outward end of the first span of the tension member 72. Each pulley creates a friction point that causes wear and increases the load required to rotate the spool 84.

The first umbrella frame pole 14 includes a channel 90 disposed between top and bottom portions of the first umbrella frame pole along a side thereof. The runner 22 is disposed about the first umbrella frame pole 14. The runner 22 has a housing 102 and a clamp 106 mounted to the housing. The clamp 106 is configured to apply pressure to the first umbrella frame pole 14 at positions along the length of the pole. The second umbrella frame pole 26 is disposed transverse to the first umbrella frame pole 14. The second pole 26 has a first end coupled with the housing of the runner 22 and a second end coupled with the canopy 18. The runner can have an arcuate seat 108A for receiving an end portion 108B of the second pole 26. The end portion 108B can have an arcuate surface that may rotate across the surface 108A. A further connection between the end portion 108B of the arm 26 and the runner con include a pin 108C disposed between the runner 22 and the end portion 108B. As the runner 22 travels along the pole 14, the arm 26 can pivot about the pin 108C and the surfaces 108A, 108B rotate relative to each other.

A canopy control module 24 is disposed on the second umbrella frame pole 26. In some embodiments, the canopy control module 24 is disposed adjacent to the runner 22. The canopy control module 24 includes a mechanism for opening and closing the canopy. The canopy control module 24 can include the spool 84 and a crank 112. In contrast to many cantilever umbrellas, the present embodiments separate the raise and lower function of the runner 22 from the opening and closing function of the canopy 18. This independent operation makes the umbrella more convenient in that the user can set the height and degree of opening of the canopy 18 as needed.

Figure 4:
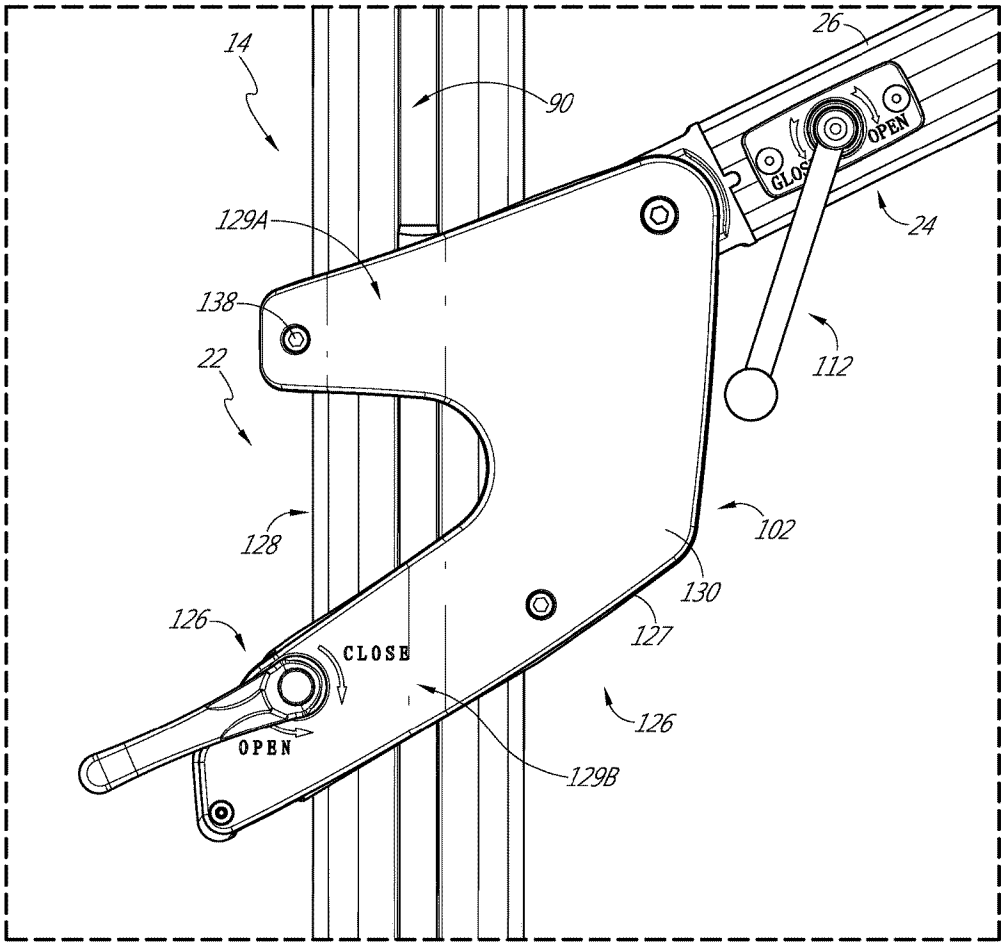
FIG. 4 is a detail view of a portion of a cantilever umbrella assembly including a runner and securing device.
Figure 5:
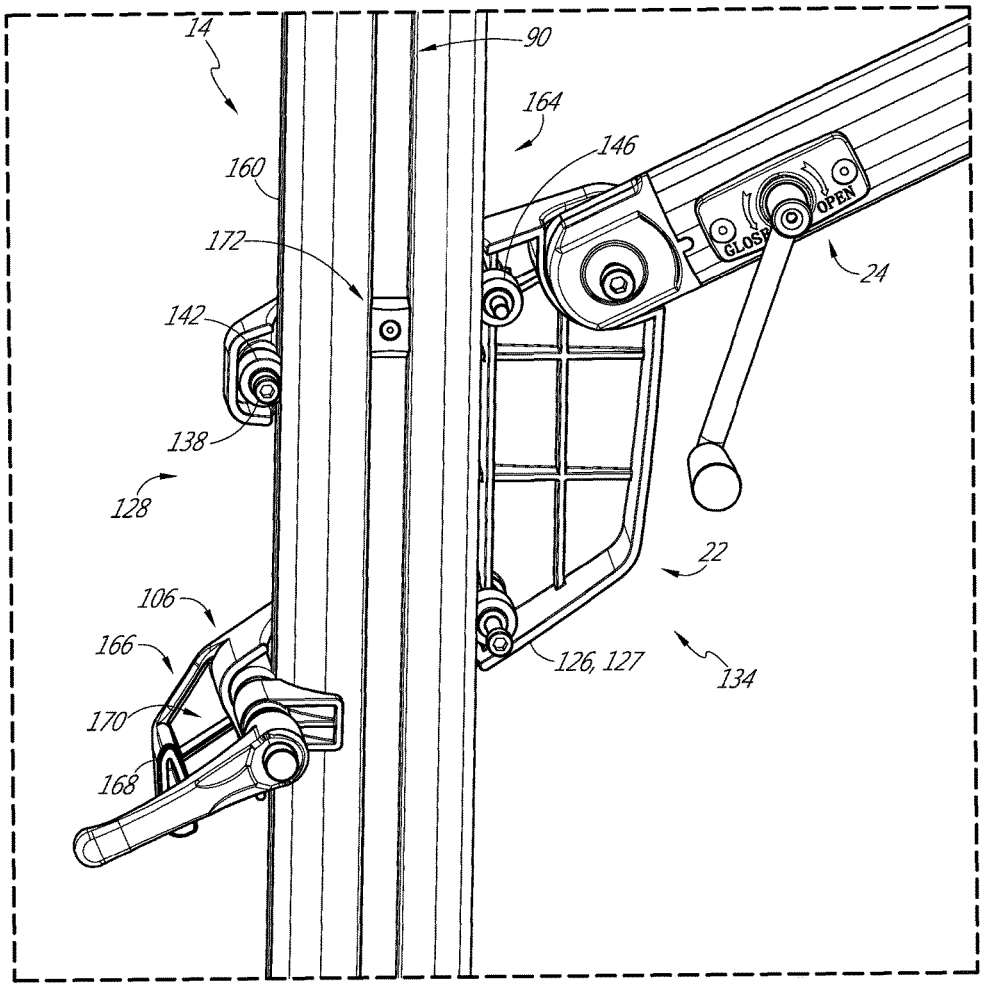
FIG. 5 is a view similar to that of FIG. 3 illustrating additional details of the connection of the runner to the upright pole.

FIGS. 4 and 6 show various features of the runner 22 in more detail. In particular, the runner 22 has a first side 126 disposed on the side of the pole 14 on which the canopy 18 is located. The runner 22 has a second side 128 disposed on the opposite side of the pole 14 on which the first side 126 is disposed. The first side 126 extends generally vertically along a short portion of the pole 14. The first side 126 has an upper transverse portion 129A and a lower transverse member 129B extending toward the second side 128 of the runner. The upper transverse member 129A wraps around the pole to an end disposed on the second side of the pole 14. The end of the upper transverse member 129A preferably is at a lower elevation than the upper end of the first side 126, which enables sheaves 142 to be at different elevations on opposite sides of the pole 14. As discussed more below the first sheave 142 can be at a lower elevation than the second sheave 146. The lower transverse member 129B wraps around the pole 14 to an end disposed on the second side of the pole 14. The end of the lower transverse member 129B preferably is at a lower elevation than the lower end of the first side 126. This arrangement enables a sheaves coupled with the end of lower transverse member 129B to be at an elevation below a sheave coupled with the first side 126. Thus, the runner 22 enables the sheaves to be staggered to four different elevations, which makes the traveling of the runner smoother. The second side 128 can be open as shown in FIG. 5, e.g., providing that the ends of the upper and lower transverse members 129A, 129B are not connected on the side of the pole to which they extend. Thus a lateral opening in the runner 22 can be provided. In this approach, a portion of the pole is uncovered between the upper and lower transverse members 129A, 129B.

A surface is provided for applying hand force to raise the runner. For example, a lower surface 127 of the first side 126 can be configured to rest in the hand of the user to allow the user to raise the runner 22 by pushing up on the surface 127. In one approach, the width of the first side 126 can be about the width of an adult human hand or greater so the hand can comfortably rest on the surface 127. Or, the end of the lower transverse member 129B can extend out by a distance sufficient to enable the user to grasp the end and push up on the runner.

The runner 22 also can have a first lateral portion 130 and a second lateral portion 134. The first and second lateral portions 130, 134 joined to provide an opening therethrough. Each of the first and second lateral portions has a portion of the first and second sides 126, 128 of the runner. The first lateral portion 130 can comprise a portion of the upper transverse portion 129 extending around a first side of the pole 14. The second lateral side 134 can comprise another portion of the upper transverse portion 129 extending around a second side of the pole 14. The first lateral portion 130 can comprise a portion of the lower transverse portion 130 extending around the first side of the pole 14. The second lateral portion 134 can comprise another portion of the lower transverse portion 130 extending around the second side of the pole 14. The vertical opening between the lateral portions 130, 134 permits relative motion of the first umbrella frame pole 14 therethrough. The first and second lateral portions 130, 134 are joined by a shaft 138. There can be a plurality of shafts 138 as illustrated. The shaft 138 also supports a sheave 142 configured to roll in the channel 90 of the first umbrella frame pole 14. The sheave 142 is disposed on the shaft 138. In one embodiment, the runner 22 includes a second sheave 146 disposed therein for engaging the first umbrella frame pole.

In some embodiments further sheaves, e.g., third and fourth sheaves, are provided on the opposite side of the pole 14 from the first and second sheaves 142, 146. The first and second sheaves can be disposed above third and fourth sheaves respectively. The first and third sheaves can be configured to roll in a first channel 160 and the second and fourth sheaves configured to roll in a second channel 164 of the first umbrella frame pole 14.

In some embodiments a handle 166 is provided on the same side of the pole 14 as the clamp 106. The handle 166 can be formed by a bar 168 having first and second portions projecting from the first and second lateral sides 126, 128 of the runner 22. A space 170 can be located between the bar 168 and the pole 14. This handle position is convenient in that it allows the user to stand on the side of the pole 14 opposite the canopy and raise or lower the runner 22 with the left hand while operating the clamp 106 with the right hand. Of course the clamp could be on the other side of the pole such that the hand grasping the handle 166 and the clamp 106 would be the opposite just recited.

A limiter 172 can be disposed in the channel 90 to limit motion of the runner 22 along the umbrella pole 14. The limiter 172 is configured to engage with one or both of the lateral portions, e.g., with the lateral portion 134, when the runner 22 reaches the elevation of the limiter 172. Thus, the runner 22 is prevented from being raised too high on the pole 14.

The clamp 106 can take any suitable form. In one embodiment, the claim 106 has a handle 190 coupled with a shaft 192 and a footing 194. A first end of the shaft is coupled with the handle 190 and a second end away from the first end is embedded in the lateral portion 134 as shown in FIG. 5. The footing 194 is housed in the first lateral portion 130. The shaft 192 extends through an aperture in the lateral portion 130 such that the handle 190 can rotate outside the lateral portion 130. The footing 194 has a curved surface facing and engaged with an outside surface of the pole 14. The footing 194 has a surface opposite the curved surface that the handle 190 acts upon. As the handle 190 is rotated clockwise, the handle engages the opposite surface of the footing 194 driving the curved surface against the pole 14. This causes enough friction between the footing and the pole 14 and/or between the second lateral portion 134 and the pole 14 to hold the second pole 26 and the canopy in an elevated position. The footing 194 could have a non-curved surface or other structure that matches a surface or structure of the umbrella pole 14. More generally the footing 194 is configured to provide mechanically engage the pole 14 to allow the height to be held constant. Other similar structures can include cam clamps, detents, self-locking gear pairs, ratchets, as examples.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A cantilever umbrella, comprising:

a canopy configured to shelter an area;

a first umbrella frame pole supporting the canopy, the first umbrella frame pole including a channel disposed between top and bottom portions of the first umbrella frame pole along a side thereof;

a runner disposed about the first umbrella frame pole, the runner having a housing and a clamp mounted to the housing, the clamp configured to apply pressure to the first umbrella frame pole at positions along the length of the first umbrella frame;

a second umbrella frame pole disposed transverse to the first umbrella frame pole, the second pole having a first end coupled with the housing of the runner and a second end coupled with the canopy, the first end of the second umbrella frame pole disposed between the second end of the second umbrella frame pole and the first umbrella frame pole;

a canopy control module disposed on the second umbrella frame pole adjacent to the runner and not within the runner, the canopy control module including a crank disposed outside of the runner and within the second umbrella frame pole to provide for opening of the canopy;

wherein the control module includes a spool and a tension member coupled with the spool, the spool being journaled within the second umbrella frame pole to wind and unwind the tension member from the spool without also tilting the second umbrella frame pole or the canopy.

2. The cantilever umbrella of claim 1, wherein the clamp and the canopy control module can be operated independently.

3. The cantilever umbrella of claim 1, wherein the housing of the runner comprises a first lateral portion and a second lateral portion, the first and second lateral portions joined to provide an opening therethrough permitting relative motion of the first umbrella frame pole therethrough.

4. The cantilever umbrella of claim 3, wherein a shaft extends between the first and second lateral portions.

5. The cantilever umbrella of claim 4, wherein the shaft also supports a sheave configured to roll in the channel of the first umbrella frame pole.

6. The cantilever umbrella of claim 5, wherein the sheave disposed on the shaft comprising a first sheave and the runner comprises a second sheave disposed therein for engaging the first umbrella frame pole.

7. The cantilever umbrella of claim 6, wherein the channel of the first umbrella frame pole comprises a first channel and further comprising a second channel, the first channel facing the second umbrella frame pole and the second channel being disposed on a side of the first umbrella frame pole opposite the first channel, the second sheave being disposed to roll within the second channel.

8. The cantilever umbrella of claim 7, wherein the first and second sheaves are disposed above third and fourth sheaves respectively, the first and third sheaves configured to roll in the first channel and the second and fourth sheaves configured to roll in the second channel of the first umbrella frame pole.

9. The cantilever of claim 1, wherein the tension member has a first end coupled with the canopy and a second end coupled to the spool, such that upon rotation of the spool, the tension member is wound on the spool and the canopy is opened.

10. The cantilever of claim 1 further comprising a stop coupled with the first umbrella frame pole to define at least one of the upper and lower end of travel of the runner.

11. The cantilever of claim 1, wherein the canopy control module is offset from the runner a lateral distance along the second umbrella frame pole.

12. The cantilever of claim 1, wherein at least a portion of the canopy control module is disposed in the second umbrella frame pole adjacent an end portion of the second umbrella frame pole, the end portion pivotably coupled with the runner.

13. A cantilever umbrella assembly, comprising:

an upright pole including an upright guide surface;

a runner coupled with the upright pole, the runner having a bearing disposed in the upright guide surface for guiding the runner along the upright pole;

a clamping mechanism coupled with the runner for holding the runner at a selected elevation along the upright pole;

a transverse pole having an end pivotably coupled with the runner;

a canopy controller comprising a crank journaled on the transverse pole between the runner and a canopy to adjust the configuration of the umbrella;

wherein the canopy controller includes a spool and a tension member connected on one end to the spool and on the other end to a canopy frame member, the spool being journaled within the transverse pole to wind and unwind the tension member from the spool without also tilting the second umbrella frame pole or the canopy.

14. The cantilever umbrella assembly of claim 13, wherein the guide surface comprises a portion of a rail disposed on an outside surface of the upright pole.

15. The cantilever umbrella assembly of claim 13, wherein the guide surface is disposed in or adjacent to an upright channel formed in the upright pole.

16. The cantilever umbrella assembly of claim 15, wherein a guide surface is provided on opposite external surfaces of the upright pole.

17. The cantilever umbrella assembly of claim 13, wherein the guide surface comprises a rail disposed on an outside surface of the upright pole.

18. The cantilever of claim 13, wherein the canopy controller is at a location offset from the runner along the transverse pole.

19. A cantilever umbrella assembly, comprising:

an upright pole comprising an upper end, a lower end, and including an upright guide surface disposed therebetween;

a runner coupled with the upright pole, the runner having a bearing coupled with the guide surface for guiding the runner along the upright pole;

a clamp coupled with the runner for holding the runner at a selected elevation along the upright pole;

a transverse pole having an end pivotably coupled with the runner;

a strut coupled with the upper end of the upright pole and with the transverse pole to support the transverse pole from above;

a deployable tension member with a first terminal end disposed in the transverse pole adjacent the upright pole and a second end coupled with a canopy; and a crank and a spool coupled with a first end to the tension member, the spool being journaled within a wall of the transverse pole to wind and unwind the tension member from the spool.

20. The cantilever umbrella assembly of claim 19, wherein a second end of the tension member is coupled with a canopy frame member.

21. The cantilever umbrella assembly of claim 19, wherein the upright guide surface comprises a portion of a rail disposed on an outside surface of the upright pole.

22. The cantilever umbrella assembly of claim 19, wherein the upright guide surface is disposed in or adjacent to an upright channel formed in the upright pole.

23. The cantilever umbrella assembly of claim 22, wherein the upright guide surface is provided on a front side of the upright pole and a second upright guide surface is disposed on an opposite outside surfaces of the upright pole.

24. The cantilever umbrella assembly of claim 19, wherein the guide surface comprises a rail disposed on an outside surface of the upright pole.

25. The cantilever of claim 19, wherein the crank and the spool are at a location between the end of the transverse pole coupled with the runner and an end of the transverse pole coupled with a canopy.

* * * * *